US005487722A

United States Patent [19]

Weaver, II et al.

[11] Patent Number: 5,487,722

[45] Date of Patent: Jan. 30, 1996

[54] APPARATUS AND METHOD FOR INTERPOSED ABDOMINAL COUNTERPULSATION CPR

[76] Inventors: Sherman E. Weaver, II; Horace Weaver, both of Box 623, Alvin, Tex. 77512-623

[21] Appl. No.: 237,720

[22] Filed: May 3, 1994

[51] Int. Cl.[6] ..... A61H 31/00

[52] U.S. Cl. ..... 601/41; 601/1

[58] Field of Search ..... 482/146, 147; 601/1, 41, 42, 44, 97; 434/262, 265

[56] References Cited

U.S. PATENT DOCUMENTS

| | | | |
|---|---|---|---|
| 1,997,715 | 4/1935 | Breen | 482/146 |
| 2,930,613 | 3/1960 | Katz | 482/146 |
| 3,556,087 | 1/1971 | Finestone et al. | 601/1 |
| 4,349,015 | 9/1982 | Alferness | 601/41 |
| 4,397,306 | 8/1983 | Weisfeldt et al. | 601/41 |
| 4,570,615 | 2/1986 | Barkalow | 601/41 |

FOREIGN PATENT DOCUMENTS

| | | | |
|---|---|---|---|
| 2286641 | 4/1976 | France | 601/41 |
| 673551 | 3/1939 | Germany | 601/41 |
| 87606 | 4/1956 | Netherlands | 601/41 |
| 1560204 | 4/1990 | U.S.S.R. | 601/41 |

*Primary Examiner*—Richard J. Apley
*Assistant Examiner*—Jeanne M. Clark
*Attorney, Agent, or Firm*—Kenneth A. Roddy

[57] ABSTRACT

An apparatus and method for administering interposed abdominal counterpulsation cardiopulmonary resuscitation (IAC-CPR) to a patient. A generally rectangular board-like device having a chest compression pad and an abdominal compression pad depending from the underside is positioned on the torso of the patient and gripped at opposed ends by the hands of a person treating the patient. Force is applied alternately to each opposed end in a "see-saw" fashion to administer chest compressions in alternating sequence to abdominal compressions corresponding to the systole and diastole heart phases. The device may have a locator aperture through which the person treating the patient may manually or visually locate the breastbone of the patient to facilitate proper positioning and the pads may be adjustably positioned relative to one another to fit various size patients. A cycle of compressions is followed by rescue breathing and repeated with pulse checks every few minutes until a pulse is detected or it is determined that further efforts would be fruitless. The interposed abdominal compressions increase intra-abdominal pressure which is transmitted to all abdominal organs. Increased pressure in the abdominal aorta during diastole improves aortic diastolic blood pressure which may lead to retrograde flow to the heart and brain and significantly increase the return of spontaneous cardiac circulation.

17 Claims, 2 Drawing Sheets

APPARATUS AND METHOD FOR INTERPOSED ABDOMINAL COUNTERPULSATION CPR

BACKGROUND OF THE INVENTION

FIELD OF THE INVENTION

This invention relates generally to cardiopulmonary resuscitation (CPR) apparatus and methods, and more particularly to a device and method for administering interposed abdominal counterpulsation CPR (IAC-CPR).

BRIEF DESCRIPTION OF THE PRIOR ART

Cardiopulmonary resuscitation (CPR) has two purposes; to keep the lungs supplied with oxygen when breathing has stopped and to keep blood circulating and carrying oxygen to the brain, heart, and other parts of the body. Brain cells begin to die after 4 to 6 minutes without oxygen. In conventional CPR, as shown in FIG. 1, the patient A is placed in a supine position, and the person B treating the patient kneels at the level of the victim's shoulders. The heels of the hands of person B are placed one on top of the other along the length of the patient's breastbone. The arms of person B are straightened and the elbows locked so that the shoulders are directly over the hands. Chest compressions are given at a rate of about 80–100 per minute by person B pushing straight down with the weight of the upper body of the person creating the pressure necessary to compress the chest 1½" to 2". Chest compression pressure is released completely to allow blood to flow into the heart and the chest returns to its normal position after each compression. After 15 chest compressions two full breaths are given mouth-to-mouth or with the aid of an air bag.

A pumping heart has two cycles; "systole" and "diastole". Systole is that part of the heart cycle in which the heart is in contraction, i.e., the myocardial fibers are tightening and shortening. During systole blood is surged through the aorta and pulmonary artery. Diastole is that part of the heart cycle during which the muscle fibers lengthen, the heart dilates, and the cavities fill with blood.

The atria are the upper chambers of each half of the heart and the ventricles are the two lower chambers that receive blood from the atria and, when filled with blood, contract during systole to propel it into the arteries. Diastole of the atria occurs before that of the ventricles. During diastole the right atrium receives deoxygenated blood from the entire body (except lungs), and the left atrium receives oxygenated blood from the lungs through the pulmonary veins. The right ventricle forces blood into the pulmonary artery and pumps it into the lungs via the pulmonary veins. The left ventricle pumps blood through the aorta and the arteries and into general circulation through the aortic valve.

Conventional CPR techniques teach chest compressions corresponding to the "systole" heart cycle accompanied by ventilation of the patient's lungs during the chest release phase or "diastole" after a number of chest compressions with mouth-to-mouth breathing or with an air bag device. The classical theory of blood flow in CPR is that during chest compression the breastbone moves down squeezing the heart and forcing the blood out of the heart into the aorta and further into peripherial blood vessels with the heart valves preventing retrograde blood flow. During chest release, the heart relaxes, and blood is drawn from the veins into the heart to create a semblance of flow.

There are several patents which disclose various apparatus and methods for conventional cardiopulmonary resuscitation (CPR), most of which utilize only chest compressions and arterial blood flow accompanied by rescue breathing.

Harris, U.S. Pat. No. 4,019,501 and Harrigan, U.S. Pat. No. 4,237,872 disclose portable air cushion devices for chest compressions which are placed over the sternum of a person and are equipped with pressure gauges to indicate the amount of pressure applied to the chest.

Lally, U.S. Pat. No. 4,554,910 discloses a portable device used for chest compressions which has a pair of spring loaded plates which are placed over the sternum and gives an audible clicking sound to indicate that the appropriate amount of pressure has been applied to the chest.

Woudenberg et al, U.S. Pat. No. 4,664,098 and Halperin et al, U.S. Pat. No. 4,928,674 disclose pnuematic bladder devices for chest compressions which are strapped over the sternum of a person and are cyclically inflated and deflated to apply pressure to the chest.

Recent studies suggest that, contrary to the previously described classical theory of blood flow during conventional CPR, the mechanism of blood flow during chest compression is not direct cardiac compression, but is related to the increase in general intrathoracic pressure. According to this theory, the pressure gradient necessary for forward flow exists outside the the chest and there is no pressure gradient between arteries and veins within the chest. Thus, the heart does not actually serve as a pump since there is nor pressure gradient across the heart.

Weisfeldt et al, U.S. Pat. No. 4,397,306 discloses an integrated electronic and pneumatic system for cardiopulmonary resuscitation and circulation support based on the above described theory which augments intrathoracic pressure and blood flow in a cyclic fashion. The system includes; a chest compressor, a high pressure ventilator for ventilating simultaneously with chest compressions, a low pressure for inflating the lungs between a selected number of compression cycles, a negative pressure ventilator for deflating the lungs between chest compressions, valve means for selectively operating only one of the ventilators at any one time, meaans for restricting the abdomen to exert pressure on the abdominal wall, and control means for controlling the operation of the system.

A procedure known as intra-aortic counterpulsation utilizes a balloon attached to a catheter which is inserted through the femoral artery into the descending throracic aorta and alternately inflating and deflating with a gas during diastole and systole respectively. This procedure permits lowering resistance to aortic blood flow during diastole and increasing resistance during systole, and results in decreasing the work of the heart and increasing the flow of blood to the coronary arteries.

A recently developed cardiopulmonary resuscitation (CPR) technique, known as "interposed abdominal counterpulsation" or IAC-CPR has been shown to have a greater success rate than standard CPR techniques in resuscitating persons whose hearts have stopped beating (The Journal Of The American Medical Association, Vol 267, page 379, Jan. 15, 1992). Interposed abdominal counterpulsation or IAC-CPR differs from conventional CPR techniques in that upper abdominal compressions are given alternately (counterpulsation) to the chest compressions. This technique utilizes both phases of the pumping heart and, as a result, increases the blood flow to the brain and heart and returns blood through the veins to the heart more quickly than standard CPR techniques which only utilize chest compressions and arterial blood flow.

One known method of applying IAC-CPR utilizes two persons B and C, as illustrated in FIG. 2. A tube is placed into the windpipe for respiration and one person B pushes on the upper abdomen of the patient A with both hands open, timing the thrusts to coincide with the relaxation phase of the chest compressions being given by the other person C to create a push/pull rhythm.

Another known IAC-CPR method utilizes balloon pumps attached to the legs or a combination of the legs and arms which squeeze the veins as well as the arteries to increase blood flow.

Zheng et al, U.S. Pat. No. 4,753,226 discloses a computerized external counterpulsation and extrathoracic cardio massage apparatus and method which utilizes balloons for the four limbs, a pair of lower-abdomen-buttock balloons, and a chest balloon controlled by a microcomputer process. The sets of balloons exert pressure sequentially from the distal portion to the proximal portion to force blood into the abdomen, chest and head, quickly deflate, then again inflate to exert pressure sequentially from the proximal portion to the distal portion to force blood back into the lower portion of the body.

The present invention is distinguished over the prior art in general, and these patents in particular by an apparatus and method by which interposed abdominal counterpulsation cardiopulmonary resuscitation (IAC-CPR) is administered to a patient. A generally rectangular board-like device having a chest compression pad and an abdominal compression pad depending from the underside is positioned on the torso of the patient and gripped at opposed ends by the hands of a person treating the patient. Force is applied alternately to each opposed end in a "see-saw" fashion to administer chest compressions in alternating sequence to abdominal compressions corresponding to the systole and diastole heart phases. The device may have a locator aperture through which the person treating the patient may manually or visually locate the breastbone of the patient to facilitate proper positioning and the pads may be adjustably positioned relative to one another to fit various size patients. A cycle of compressions is followed by rescue breathing and repeated with pulse checks every few minutes until a pulse is detected or it is determined that further efforts would be fruitless. The interposed abdominal compressions increase intra-abdominal pressure which is transmitted to all abdominal organs. Increased pressure in the abdominal aorta during diastole improves aortic diastolic blood pressure which may lead to retrograde flow to the heart and brain and significantly increase the return of spontaneous cardiac circulation.

SUMMARY OF THE INVENTION

It is therefore an object of the present invention to provide an apparatus and method for administering interposed abdominal counterpulsation cardiopulmonary resuscitation whereby abdominal compressions are given alternately to the chest compressions to utilize both phases of a pumping heart and increase the blood flow to the brain and heart and return blood through the veins to the heart.

It is another object of this invention is to provide a manually operated device for administering interposed abdominal counterpulsation cardiopulmonary resuscitation which, small, lightweight, and portable.

Another object of this invention is to provide a manually operated device for administering interposed abdominal counterpulsation cardiopulmonary resuscitation which is quickly deployed for use in emergency situations.

Another object of this invention is to provide a manually operated device for administering interposed abdominal counterpulsation cardiopulmonary resuscitation which can be operated by a single person.

Another object of this invention is to provide a manually operated device for administering interposed abdominal counterpulsation cardiopulmonary resuscitation which can be easily and quickly adjusted to fit various size victims.

Another object of this invention is to provide a manually operated device for administering interposed abdominal counterpulsation cardiopulmonary resuscitation which is configured to allow the person treating a victim to easily and quickly position the device in the proper position.

A further object of this invention is to provide a manually operated device for administering interposed abdominal counterpulsation cardiopulmonary resuscitation which allows substantial access to the chest and abdominal areas while the victim is being treated.

A still further object of this invention is to provide a device for administering interposed abdominal counterpulsation cardiopulmonary resuscitation which is simple in construction, economical to manufacture, and rugged and reliable in use.

Other objects of the invention will become apparent from time to time throughout the specification and claims as hereinafter related.

The above noted objects and other objects of the invention are accomplished by an apparatus and method by which interposed abdominal counterpulsation cardiopulmonary resuscitation (IAC-CPR) is administered to a patient. A generally rectangular board-like device having a chest compression pad and an abdominal compression pad depending from the underside is positioned on the torso of the patient and gripped at opposed ends by the hands of a person treating the patient. Force is applied alternately to each opposed end in a "see-saw" fashion to administer chest compressions in alternating sequence to abdominal compressions corresponding to the systole and diastole heart phases. The device may have a locator aperture through which the person treating the patient may manually or visually locate the breastbone of the patient to facilitate proper positioning and the pads may be adjustably positioned relative to one another to fit various size patients. A cycle of compressions is followed by rescue breathing and repeated with pulse checks every few minutes until a pulse is detected or it is determined that further efforts would be fruitless. The interposed abdominal compressions increase intra-abdominal pressure which is transmitted to all abdominal organs. Increased pressure in the abdominal aorta during diastole improves aortic diastolic blood pressure which may lead to retrograde flow to the heart and brain and significantly increase the return of spontaneous cardiac circulation.

DESCRIPTION OF THE PREFERRED EMBODIMENT

Figure 1:
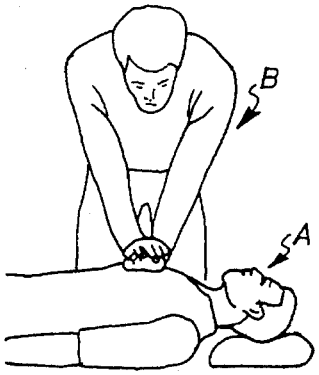
FIG. 1 (PRIOR ART)
FIG. 1 is an illustration of the prior art method of administering conventional cardiopulmonary resuscitation (CPR) using only chest compressions accompanied by rescue breathing.
Figure 2:
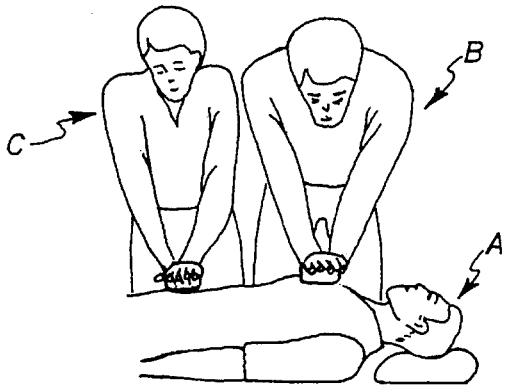
FIG. 2 (PRIOR ART)
FIG. 2 is an illustration of the prior art method of interposed abdominal counterpulsation (IAC-CPR) utilizing two persons to alternately administer abdominal compressions and chest compressions.
Figure 3:
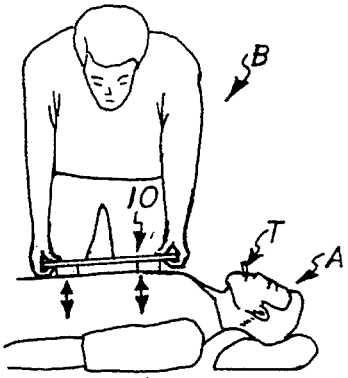
FIG. 3 is an illustration of the method of interposed abdominal counterpulsation (IAC-CPR) utilizing the device and method in accordance with the present invention to alternately administer abdominal compressions and chest compressions.
Figure 4:
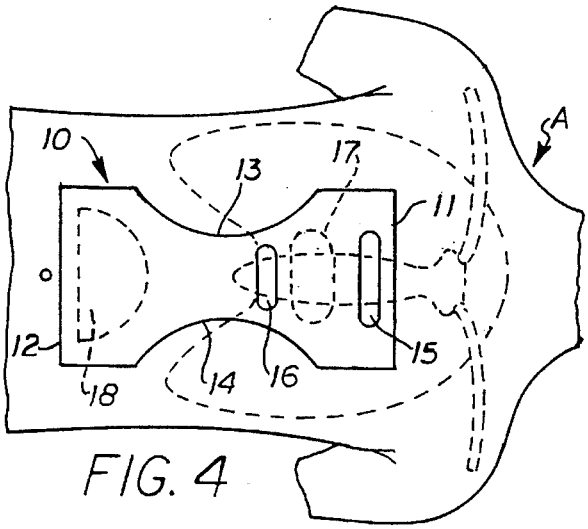
FIG. 4 is a schematic top plan view of the torso of a patient showing the device for administering interposed abdominal counterpulsation (IAC-CPR) positioned thereon.
Figure 5:
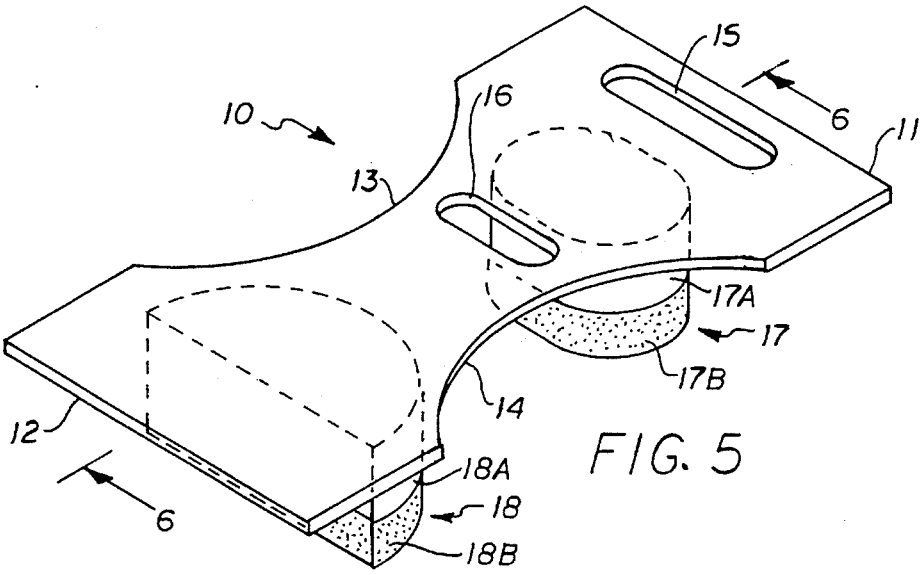
FIG. 5 is an isometric view of a device for administering interposed abdominal counterpulsation (IAC-CPR) in accordance with the present invention.
Figure 6:
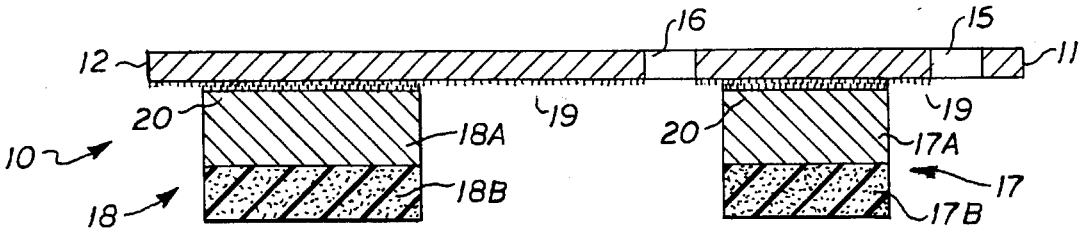
FIG. 6 is a longitudinal cross section through the device for administering interposed abdominal counterpulsation (IAC-CPR) taken along line 6—6 of FIG. 5.

Referring now to FIGS. 3–6, the present invention utilizes the recently developed technique known as "interposed abdominal counterpulsation" cardiopulmonary resuscitation or "IAC-CPR" wherein upper abdominal compressions are given alternately (counterpulsation) to the chest compressions. A preferred portable manual device 10 for administering IAC-CPR is shown in FIGS. 4, 5, and 6.

The preferred device 10 is a generally rectangular board-like structure formed rigid material, such as wood or plastic. The apparatus 10 has opposed ends 11 and 12 which are gripped by the left and right hands of the person treating the patient (FIG. 3). The longitudinal sides 13 and 14 of the device 10 may be curved inwardly to facilitate access to the abdominal and chest areas. A transverse aperture or slot 15 may also be formed in the structure 10 near one or both ends to facititate carrying or gripping, and to provide a means by which the structure may be hung for storage.

A transverse locator aperture or slot 16 spaced inwardly from one end is formed in the device 10 through which the fingers of the person treating the patient may be inserted to locate the breastbone (sternum) and properly position the device on the patient as illustrated in FIG. 4. The person treating the patient should be able to feel the notch where the ribs meet the breastbone in the center of the lower part of the chest, and in some instances, the notch may be observed through the slot 16.

A chest compression pad 17 is disposed on the underside of the device 10 between one end 11 and the locator slot 16, and an abdomen compression pad 18 is disposed on the underside inwardly of the opposite end of the device. In the illustrated example, the chest compression pad 17 is a generally oval configuration and the abdomen compression pad 18 is generally semi-circular as seen from the top, however, other shapes may be provided.

As best seen in FIG. 6, the chest and abdomen compression pads 17 and 18 are formed of a top section 17A and 18A, respectively, of rigid material such as wood or plastic, and a lower section 17B and 18B, respectively, formed of a suitable resilient material such as high density closed cell polyurethane foam or neoprene secured to the upper section. In the embodiment of FIG. 6, a strip of one element of a hook-and-loop fastener material 19 is secured longitudinally to the underside of the device 10 and strips of the mating elements of the hook-and-loop fastener material 20 are secured the top of the upper sections 17A and 18A of the pads 17 and 18. Thus, the pads 17 and 18 can be quickly and easily detached and repositioned at various locations along the length of the device according to the size of the patient.

It should be understood, that the pads 17 and 18 may be permanently secured to the underside of the device 10. It should also be understood that the pads 17 and 18 may be formed entirely of suitable resilient material and releasably fastened directly to the hook and loop fastener material 19 on the underside of the device 10, depending upon the hardness of the resilient material. For example, it has been found that neoprene and some other resilient materials will engage with the loop element of the hook and loop fastener material. However, the pads 17 and 18 must have sufficient hardness to compress the breastbone approximately 1½" to 2".

Figure 7:
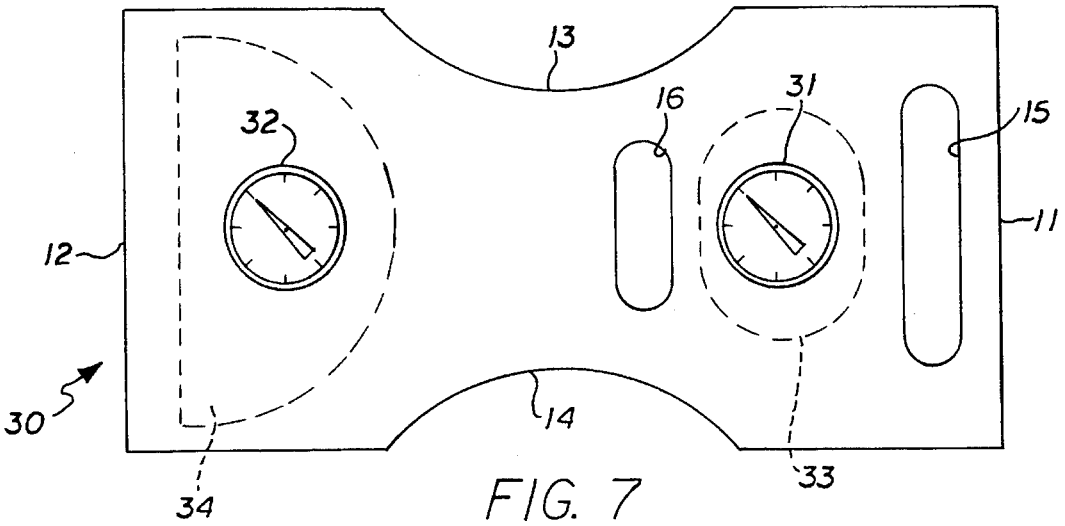
FIG. 7 is a top plan view of a device for administering interposed abdominal counterpulsation (IAC-CPR) having a set of pressure indicators.
Figure 8:
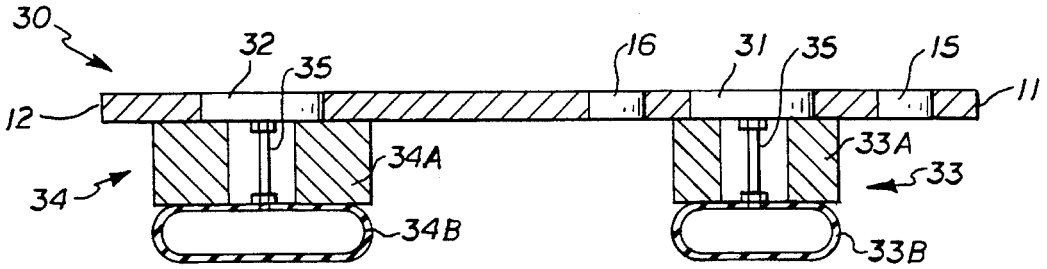
FIG. 8 is a longitudinal cross section through the device for administering interposed abdominal counterpulsation (IAC-CPR) taken along line 8—8 of FIG. 7.

Referring now to FIGS. 7 and 8, there is shown another embodiment of the device 30. The device 30 is a generally rectangular board-like structure formed rigid material and with opposed ends 11 and 12, longitudinal sides 13 and 14, a transverse locator aperture or slot 16, and may have a transverse aperture or slot 15 near one or both ends, as previously described. In this embodiment, the device 30 is provided with pressure indicators 31 and 32 which are visible from the top side. The device 30 has pneumatic or hydraulic chest and abdomen compression pads 33 and 34, respectively, which are formed of a top section 33A and 34A, respectively, of rigid material such as wood or plastic and have fluid filled bladders 33B and 34B, respectively, secured to the upper sections and joined to the indicators 31 and 32 by conduit 35. Thus, with this embodiment, the person treating the patient can observe the amount of pressure being exerted on the chest and abdomen during the compression cycles. The device 30 may also be used in training and practice sessions.

OPERATION

Referring again to FIGS. 3–5, the method of administering interposed abdominal counterpulsation (IAC-CPR) utilizing the device 10 will be described.

The patient A is placed in a supine position, and the person B treating the patient kneels at one side in a position between the patient's shoulders and hips. If the patient is not breathing, two full breaths should be administered by mouth-to-mouth breathing or an air bag device. A breathing tube T, if available, is placed into the windpipe for respiration. The patient's carotid pulse should be checked for heartbeat. If there is no pulse, the device 10 should be used.

As seen in FIGS. 3 and 4, the device 10 is placed over the patient's torso with its longitudinal axis aligned with the longitudinal axis of the patient's body with the end (11) of the device having the locator slot 16 positioned over the chest area and the opposite end over the abdominal area. The person treating the patient places his or her fingers through the locator slot 16 to locate the breastbone (sternum) of the patient A. The person treating the patient should be able to feel the notch where the ribs meet the breastbone in the center of the lower part of the chest, and in some instances, the notch may be observed through the locator slot 16.

When properly positioned, the chest compression pad 17 on the underside of the device should be located just above the notch where the ribs meet the breastbone in the center of the lower part of the chest and the abdomen compression pad 18 should be located just above the patient's umbilicus (navel). If the pads 17 and 18 are not properly located, they should be repositioned by detaching the fabric fasteners 19–20 and reengaging the fasteners to position the pads relative to one another so that they will rest in the proper position in relation to the notch and navel.

The person treating the patient then grips the opposite ends 11 and 12 of the device 10. The arms are straightened and the elbows locked so that the person treating the patient's shoulders are directly over the hands. The person treating the patient then pushes straight down on the end of the device over the chest area with the weight of the upper body creating the pressure necessary to compress the chest 1½" to 2", then raises the end of the device while pushing down on the opposite end to compress the abdomen, then relaxing the abdominal compression, and repeating the cycle, timing the abdominal compressions to coincide with the relaxation phase of the chest compressions in a "see-saw" motion.

The chest compressions are given alternately with abdominal compressions at a rate of about 80–100 per minute. The abdominal compressions should be coordinated to coincide with the early relaxation phase of chest compressions. The recommended compression force is 100+/–20 mm Hg. Chest compression pressure should be released completely to allow blood to flow into the heart and the chest to return to its normal position after each compression. After 15 chest compressions two full breaths (mouth-to-mouth) are given.

The cycle of 15 compressions followed by 2 breaths should continue for at least 4 cycles. After the 2 breaths at the end of the 4th cycle, the patient should be checked to see if there is a pulse. If there is no pulse, 2 breaths should be given and the alternating chest and abdominal compression cycle repeated with pulse checks every few minutes.

Abdominal compression and chest compressions should continue until a pulse is detected or it is determined that further resuscitation efforts would be fruitless. A sucessful resuscitation is usually defined as the presence of a palpable femoral arterial pulse and a systolic blood pressure greater than 80 mm Hg for longer than three minutes. If there is a pulse, then check for breathing. If the patient is breathing, keep the airway open and closely monitor breathing and pulse.

The interposed abdominal compression during diastole increases intra-abdominal pressure, which is transmitted to all abdominal organs. Increased pressure in the abdominal aorta during diastole improves aortic diastolic blood pressure which may lead to retrograde flow to the heart and brain and significantly increases the chances in the return of spontaneous circulation from cardiac arrest.

It can be seen from the foregoing description that the present device facilitates an improved method for administering interposed abdominal counterpuslsion CPR in a technique which utilizes both phases of the pumping heart and, as a result, increases the blood flow to the brain and heart and returns blood through the veins to the heart more quickly than standard CPR techniques which only utilize chest compressions and arterial blood flow accompanied by rescue breathing.

The IAC-CPR technique can be accompanied other aspects of conventional CPR methods, such as the administration of resuscitation medications. The shape of the device facilitates easy access to the chest and abdominal areas for giving injections and medications. The device is easily portable and can be conveniently stored for use in an emergency situation.

While this invention has been described fully and completely with special emphasis upon a preferred embodiment, it should be understood that within the scope of the appended claims the invention may be practiced otherwise than as specifically described herein.

We claim:

1. A device for manually administering interposed abdominal counterpulsation cardiopulmonary resuscitation (IAC-CPR) to a patient comprising:

a longitudinal generally flat rectangular member formed of substantially rigid material having a top side, an underside, and opposed ends configured to be gripped by the left and right hands, respectively, of a person treating the patient, a first force-transmitting element adjustably fixed to said underside configured to engage a patient's chest region, and a second force-transmitting element adjustably fixed to said underside configured to engage the patient's abdominal region;

said first and second force-transmitting elements spaced longitudinally apart from one another;

said rectangular member being positioned on the patient's torso with its longitudinal axis aligned generally with the longitudinal axis of the patient's body and said first and second force-transmitting elements engaged on the patient's chest region and abdominal region, respectively, and said opposed ends being gripped by the hands of the person treating the patient for applying force to said rectangular member; and manual force being applied by the person treating the patient alternately to each one of said opposed ends in alternating sequence to administer chest compressions in alternating sequence to abdominal compressions.

2. A device according to claim 1 wherein said rectangular member is apertured to receive the hand of an individual to facilitate manual carrying and provide a means by which said rectangular member may be hung for storage.

3. A device according to claim 1 including a locator aperture in said rectangular member through which the person treating the patient may manually or visually locate the breastbone of the patient to facilitate proper positioning of said device on the chest and abdominal areas of the patient.

4. A device according to claim 1 wherein said rectangular member has inwardly curved longitudinal sides to allow physical access to the abdominal and chest areas of the patient being treated.

5. A device according to claim 1 wherein said first and said second force-transmitting elements are formed of resilient material.

6. A device according to claim 1 wherein said first and said second force-transmitting elements each have a resilient bottom portion.

7. A device according to claim 6 wherein said resilient bottom portion of said first and said second force-transmitting elements is formed of resilient material.

8. A device according to claim 1 wherein at least one of said first and said second force-transmitting elements is connected with the underside of said rectangular member such that said force-transmitting elements may be selectively positioned relative to one another to engage the chest and abdominal areas of various size patients.

9. A device according to claim 8 including releasable fastener means disposed between said underside of said rectangular member and at least one of said first and said second force-transmitting elements, and at least one of said first and said second force-transmitting elements is releasably fastened to the underside of said rectangular member by said releasable fastener means such that said force-transmitting elements may be selectively positioned relative to one another to engage the chest and abdominal areas of various size patients.

10. A device according to claim 9 wherein said releasable fastener means comprises a strip of at least one element of a hook-and-loop material on said underside of said rectangular member and at least one of said first and said second force-transmitting elements is releasably engagable therewith.

11. A device according to claim 9 wherein said releasable fastener means comprises a strip of at least one element of a hook-and-loop material on said underside of said rectangular member and a mating element of said hook-and-loop material on at least one of said first and said second force-transmitting elements for releasable engagement therewith.

12. A device for manually administering interposed abdominal counterpulsation cardiopulmonary resuscitation (IAC-CPR) to a patient comprising:

a longitudinal generally flat rectangular member formed of substantially rigid material having a top side, an underside, and opposed ends configured to be gripped by the left and right hands, respectively, of a person treating the patient, a first force-transmitting element depending from said underside configured to engage a patient's chest region, and a second force-transmitting element depending from said underside configured to engage the patient's abdominal region;

said first and second force-transmitting elements spaced longitudinally apart from one another and each having a fluid filled resilient bottom portion;

said rectangular member being positioned on the patient's torso with its longitudinal axis aligned generally with the longitudinal axis of the patient's body and said bottom portions of said first and second force-transmitting elements engaged on the patient's chest region and abdominal region, respectively, and said opposed ends being gripped by the hands of the person treating the patient for applying force to said rectangular member; and force being applied by the person treating the patient alternately to each one of said opposed ends in alternating sequence to administer chest compressions in alternating sequence to abdominal compressions.

13. A device according to claim 12 including indicator means operatively connected with said resilient fluid filled bottom portions for indicating the force being alternately transmitted by said force-transmitting elements to the chest and abdominal areas of the patient.

14. A method for manually administering interposed abdominal counterpulsation cardiopulmonary resuscitation (IAC-CPR) to a patient comprising the steps of:

providing a substantially rigid longitudinal generally flat rectangular device having a top side, an underside, and opposed ends configured to be gripped by the left and right hands, respectively, of a person treating the patient, a first force-transmitting element depending from said underside configured to engage the patient's chest region, and a second force-transmitting element depending from said underside spaced longitudinally from said first element configured to engage the patient's abdominal region;

positioning said device on the patient's torso with its longitudinal axis aligned generally with the longitudinal axis of the patient's body and said first and second force-transmitting elements engaged on the patient's chest region and abdominal region, respectively;

gripping said opposed ends of said device; and manually applying force alternately to each one of said opposed ends in alternating sequence to administer chest compressions in alternating sequence to abdominal compressions.

15. The method according to claim 14 wherein said device includes a locator aperture configured to allow passage of the fingers of the person treating said patient and through which the person treating the patient may manually locate the breastbone of the patient being treated, and said step of positioning said device on the patient's torso includes;

placing said device over the patient's torso with its longitudinal axis aligned with the longitudinal axis of the patient's body and said locator aperture positioned over the chest area, placing the fingers of the person treating the patient through said locator aperture to locate the breastbone and feel the notch where the ribs meet the breastbone in the center of the lower part of the chest, and positioning said device over the patient's torso with respect to the finger placement so that said first force-transmitting element is engaged on the chest area a short distance above the notch where the ribs meet the breastbone in the center of the lower part of the chest and said second force-transmitting element is engaged on the abdominal area a short distance above the navel of the patient.

16. The method according to claim 14 wherein said device includes a locator aperture configured to allow visual observation of the breasbone of the patient and through which the person treating the patient may visually locate the breastbone of the patient being treated, and said step of positioning said device on the patient's torso includes;

placing said device over the patient's torso with its longitudinal axis aligned with the longitudinal axis of the patient's body and said locator aperture positioned over the chest area such that the notch where the ribs meet the breastbone in the center of the lower part of the chest is observed, and positioning said device over the patient's torso with respect to the observed notch so that said first force-transmitting element is engaged on the chest area a short distance above the notch where the ribs meet the breastbone in the center of the lower part of the chest and said second force-transmitting element is engaged on the abdominal area a short distance above the navel of the patient.

17. The method according to claim 14 wherein said first and second force-transmitting elements are connected with said device to allow relative positioning thereof with respect to one another, and said step of positioning said device on the patient's torso includes;

placing said device over the patient's torso with its longitudinal axis aligned with the longitudinal axis of the patient's body with said first force-transmitting element engaged on the chest area a short distance above the notch where the ribs meet the breastbone in the center of the lower part of the chest and observing the initial position of said second force-transmitting element to determine its location over the abdominal area; and positioning said first and second force-transmitting elements relative to one another such that said first force-transmitting element will engage the chest area a short distance above the notch where the ribs meet the breastbone in the center of the lower part of the chest and said second force-transmitting element will engage the abdominal area a short distance above the navel of the patient.

* * * * *